US005967520A

United States Patent [19]

Chen

[11] Patent Number: 5,967,520

[45] Date of Patent: Oct. 19, 1999

[54] MODIFIED DART-BOARD

[76] Inventor: Ying Tse Chen, No. 21, Lane 187, Nan Men Road, Tainan, Taiwan

[21] Appl. No.: 09/053,917

[22] Filed: Apr. 1, 1998

[51] Int. Cl.[6] ..... F41J 3/02

[52] U.S. Cl. ..... 273/348.3

[58] Field of Search ..... 273/348.3, 408

[56] References Cited

U.S. PATENT DOCUMENTS 5,005,841 4/1991 Klick ..... 273/348.3

5,775,694 7/1998 Jonsson ..... 273/348.3

*Primary Examiner*—William H. Grieb

*Attorney, Agent, or Firm*—Pro-Techtor International Services

[57] ABSTRACT a modified structure of a dart-board comprised of a dart-board, made of paper board, plastic or other magnetic susceptible material, with surface divided into a multiple of scoring segment; a magnetic inductor made of magnetic inducing material provided behind and in the same size and shape of the dart-board to attract the dart point to land at; and a support frame with its inner contour having the same size and shape as that of the dart-board and the magnetic inductor to house both dart-board and magnetic inductor, a ring locking shield protruding inward provided to the edge of said opening to latch both dart-board and magnetic inductor; featuring that slits are provided without magnetic inductor at boundary line to abutted segments on the dart-board corresponding to the magnetic inductor so that when a dart with magnetic point lands on said boundary line, the dart will naturally be attracted by and guided to the segment to score.

2 Claims, 4 Drawing Sheets

MODIFIED DART-BOARD

BACKGROUND OF THE INVENTION

The present invention relates to a modified structure of a dart-board, more particularly, to one that can guide the dart thrown and standing at the ring line that prevents scoring to fall in the scoring segment.

The prior art of the game of darts generally uses two types of dart, respectively are one with a metallic point and the other with a magnetic point. The former, essentially comprised of a dart with sharpened point fixed to a shaft barrel of the dart so that when thrown it may insert into the dart-board, presents more dangers as people in the playing area may get hurt by the dart; and the latter, essentially comprised of a dart with its point mounted in a magnetic member while the inner layer of the dart-board a metal panel to attract the dart thrown at, thus is safer than the former. The present invention is designed by modifying this type of magnetic dart-board.

The prior art of the magnetic dart-board is essentially comprised of a board made of magnetic susceptible material (e.g. paper board, PVC), with its surface divided into a multiple of segment as scoring areas; a support frame mounted behind the dart-board; and a magnetic inductor (e.g. a metal plate)in the size and shape exactly the same as those of the dart-board is provided between said dart-board and said support frame, so to attract the dart thrown at.

However, in the prior art of the magnetic dart-board usually will also attract the dart to stand just at the ring line between the scoring segments instead of falling into either scoring segment to prevent the scoring.

BRIEF DESCRIPTION OF THE DRAWINGS

The primary purpose of the present invention is to provide a modified structure of the magnetic dart-board that will prevent the dart thrown from standing at any ring line provided on the dart-board.

To achieve the aforesaid purpose, technical means and physical structure of the present invention can be better understood by a preferred embodiment in conjunction with the following drawings.

DESCRIPTION OF THE PREFERRED EMBODIMENTS

Figure 1:
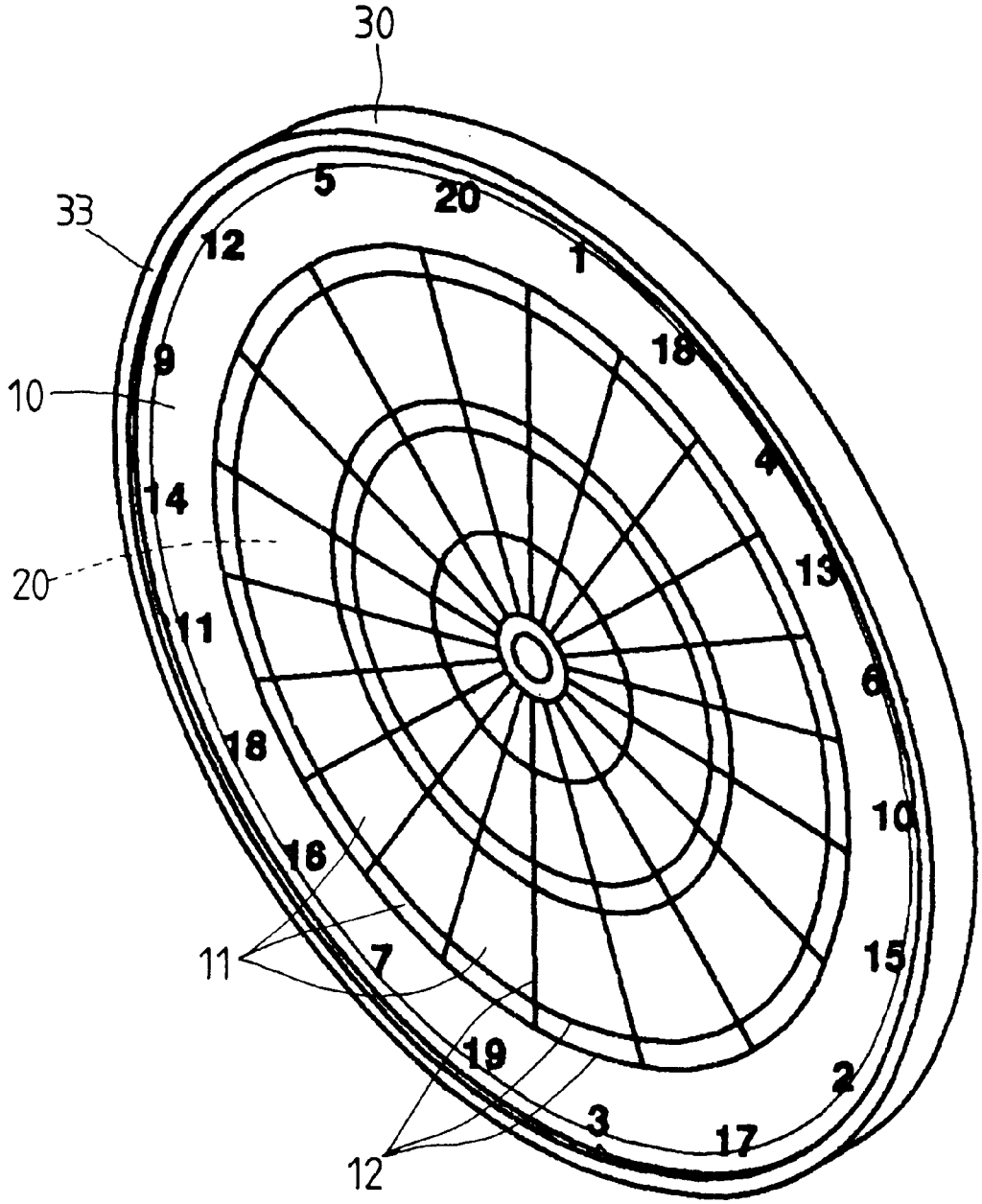
FIG. 1 is a prospective view of an assembly of the preferred embodiment of the present invention.
Figure 2:
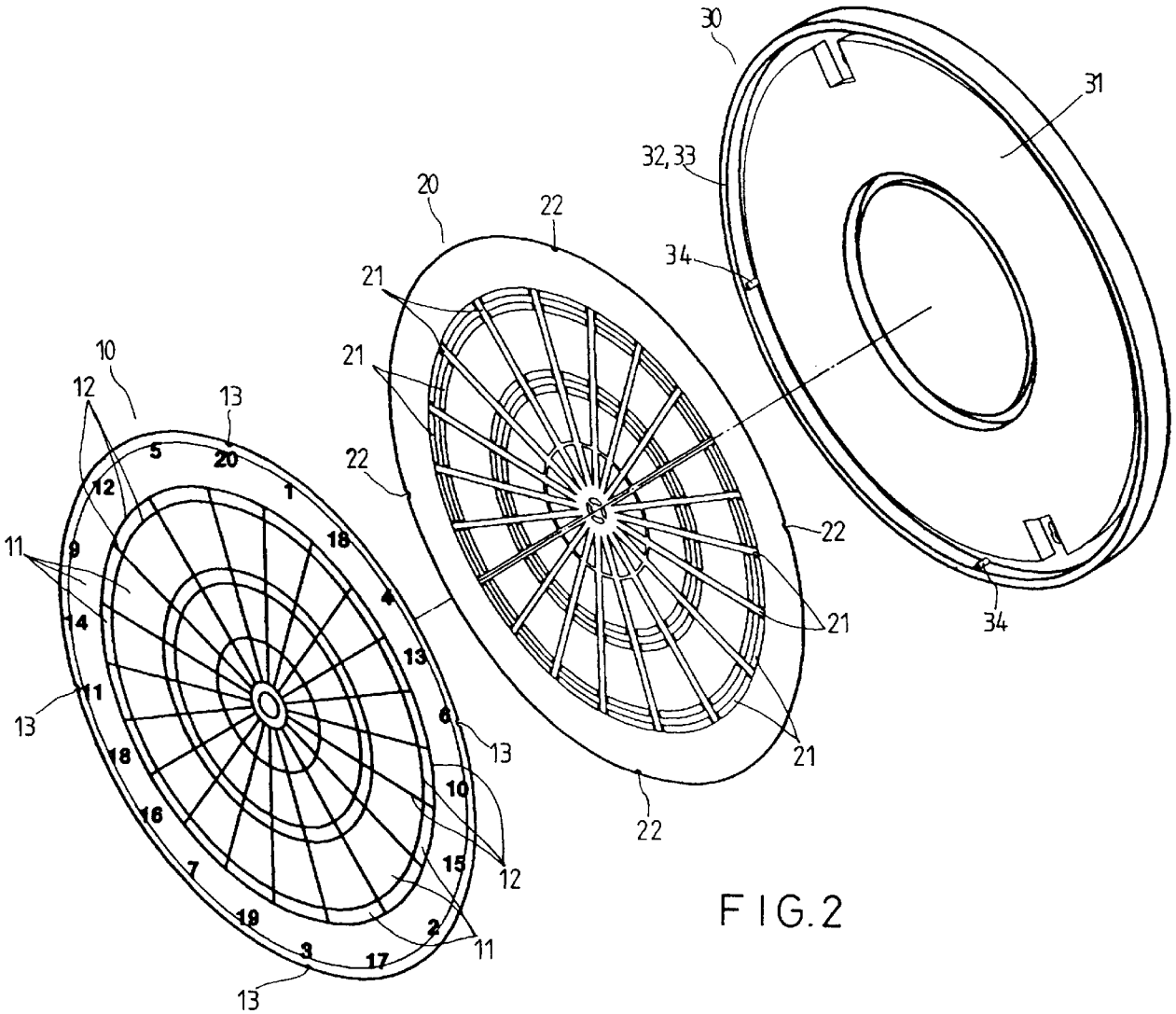
FIG. 2 is a blow-out view of the preferred embodiment of the present invention.

By referring to FIGS. 1 and 2, the dart-board of the present invention is essentially comprised of a dart-board 10, made of paper board, plastic or other magnetic susceptible material, with surface divided into a multiple of scoring segment 11 by score number (including zero); a magnetic inductor 20 made of magnetic inducing material is provided behind and in the same size and shape of said dart-board 10 to attract the dart with magnetic point to land at; and a support frame 30 with its inner contour having the same size and shape as that of said dart-board 10 and said magnetic inductor 20, an enclosed back 31and an opening 32 in its peripheral to house both of said dart-board 10 and said magnetic inductor 20 with the latter in the middle. A ring locking shield 33 protruding inward is provided to the edge of said opening 32 to latch both of said dart-board 10 and magnetic inductor 20 in said support frame 30(as illustrated in FIG. 4).

Figure 3:
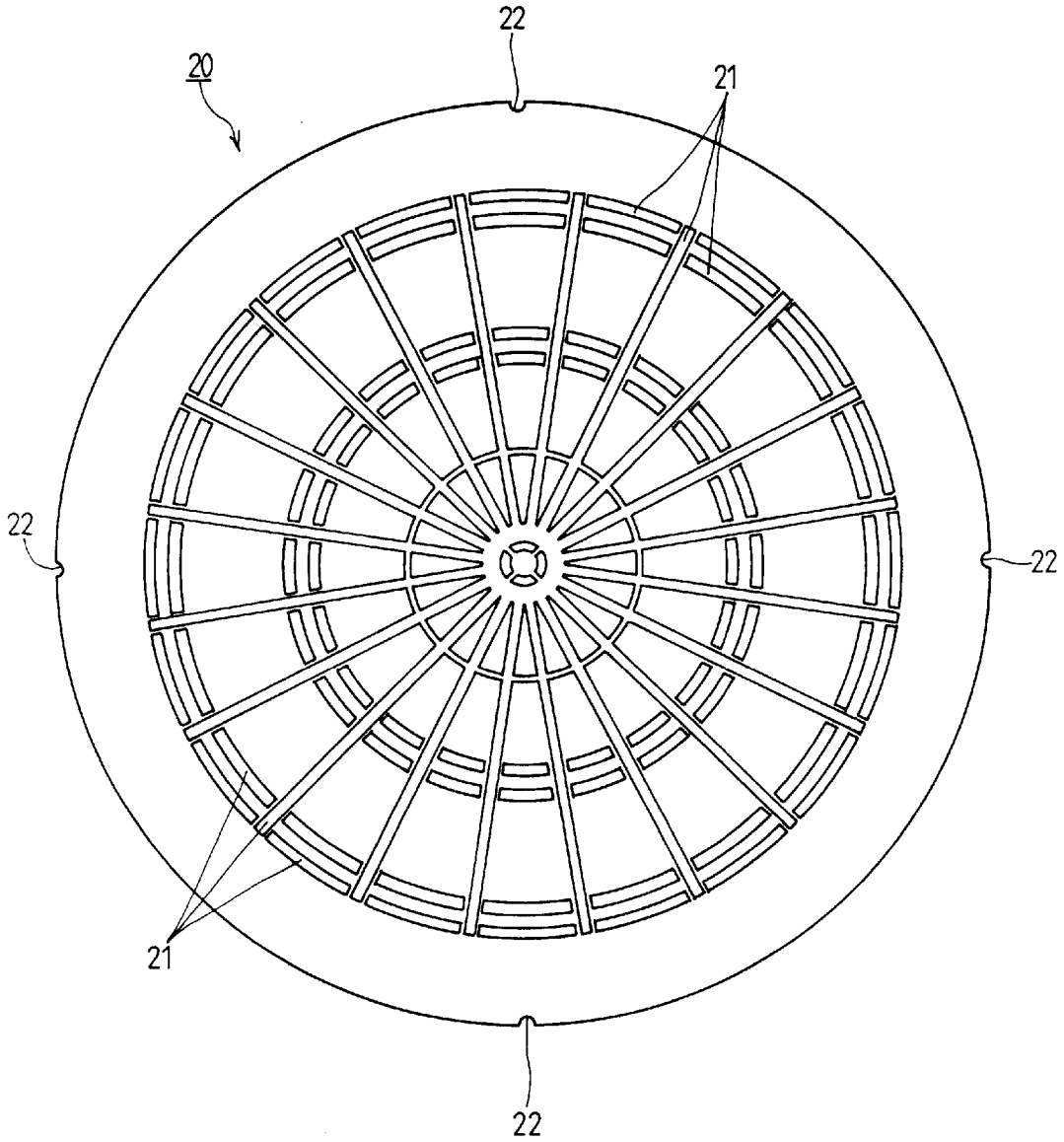
FIG. 3 is a front view of the magnetic conductor of the preferred embodiment of the present invention.

As illustrated in FIG. 3, slits 21 are provided on said magnetic inductor 20 respectively at a boundary line 12 where any two abutted scoring segments 11 and 12 meet on said dart-board 10 so that any dart thrown at will be attracted to where falling within said segment 11 and never on said boundary line that prevents from scoring. Furthermore, latching eyes 13 and 22 recessed inward are provided at proper spacing on the outer edges of both of said dart-board 10 and said magnetic inductor 20 to serve as the alignment marks for the boundary line12 on said dart-board 10 with the slit 21 on said magnetic inductor 20 to ensure the correct alignment mutually between the boundary line 12 to the scoring segment of the dart-board and the slit 21 of said magnetic inductor 20. A locking key protruding from the inner peripheral of said support frame is provided corresponding to said latching eyes 13 and 22 to mutually interlock(as illustrated in FIG. 4) so to ensure that the assembly of said dart-board 10, said magnetic inductor 20 and said support frame 30 is in place free of any placement and the permanent alignment mutually between the boundary line 12 of said dart-board 10 and the slit 21 of said magnetic inductor 20.

Figure 4:
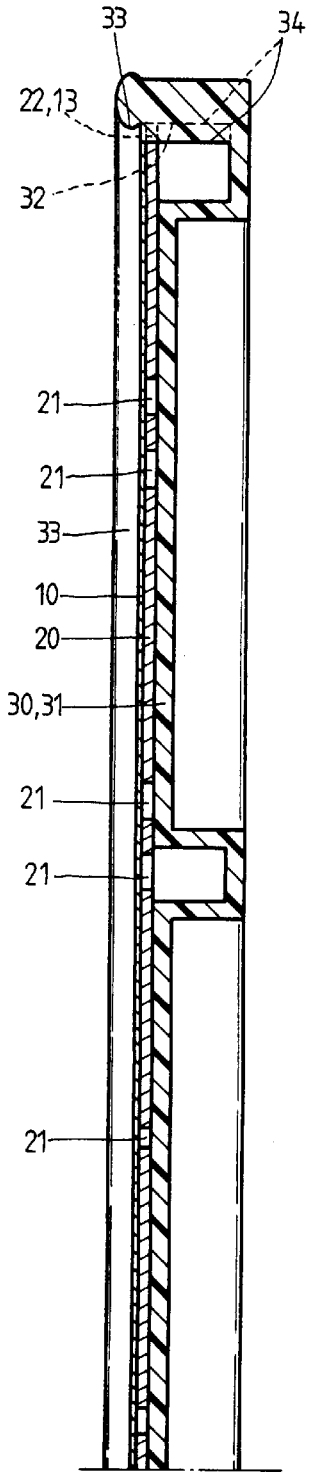
FIG. 4 is a sectional view of a part of the preferred embodiment of the present invention.

FIGS. 1 and 4 show the modified dart-board of the present invention when assembled. When in use, if any dart with magnetic point aiming at said dart-board 10 lands on said boundary line 12, the dart will naturally be guided to and attracted by the segment having comparatively larger area to either side of said boundary line 12 due to the absence of magnetic inducing material at said slit 21 where said magnetic inductor 20 on the back of said dart-board 10 corresponds to said boundary line 12 making it possible for the scoring.

I claim:

1. a modified structure of a dart-board, including a dart-board, made of magnetic susceptible material with its surface divided into a multiple scoring segment; a magnetic inductor made of magnetic inducing material having size and shape exactly the same as those of the dart-board, provided on the back of the dart-board to attach to a dart thrown at; and a support frame with its inner contour identical to that of and to hold in place the dart-board and the magnetic inductor featuring that a slit is provided without magnetic inductor at the boundary line to abutted segments on the dart-board corresponding to the magnetic inductor so that when a dart lands on said boundary line, the dart will naturally be attracted by and guided to the segment to score.

2. a modified structure of a dart-board as claimed in claim 1; within, mutually corresponding latching eyes are provided to protrude from the peripherals respectively of the dart-board and the magnetic inductor to serve the alignment marks for a boundary line on the dart-board and a list on the magnetic inductor, and a locking key protruding from the inner wall of the support frame to engage the latching eye to prevent displacement.

* * * * *